US012622459B2

(12) United States Patent
Angell et al.

(10) Patent No.: US 12,622,459 B2
(45) Date of Patent: May 12, 2026

(54) AEROSOL PROVISION SYSTEM

(71) Applicant: Nicoventures Trading Limited, London (GB)

(72) Inventors: Terry Lee Angell, London (GB); Joseph Sutton, London (GB)

(73) Assignee: NICOVENTURES TRADING LIMITED, London (GB)

( * ) Notice: Subject to any disclaimer, the term of this patent is extended or adjusted under 35 U.S.C. 154(b) by 461 days.

(21) Appl. No.: 17/758,430

(22) PCT Filed: Aug. 5, 2020

(86) PCT No.: PCT/GB2020/051868
§ 371 (c)(1),
(2) Date: Jul. 6, 2022

(87) PCT Pub. No.: WO2021/140307
PCT Pub. Date: Jul. 15, 2021

(65) Prior Publication Data

US 2023/0021690 A1 Jan. 26, 2023

(30) Foreign Application Priority Data

Jan. 8, 2020 (GB) ..... 2000237

(51) Int. Cl.
*A24F 40/42* (2020.01)
*A24F 15/015* (2020.01)
(Continued)

(52) U.S. Cl.
CPC ..... *A24F 40/42* (2020.01); *A24F 15/015* (2020.01); *A24F 40/10* (2020.01); *A24F 40/485* (2020.01)

(58) Field of Classification Search
None
See application file for complete search history.

(56) References Cited

U.S. PATENT DOCUMENTS 5,217,442 A 6/1993 Davis
8,820,521 B2 9/2014 Hodgson et al.
(Continued)

FOREIGN PATENT DOCUMENTS

CN 107961433 A 4/2018
CN 209883062 U 1/2020
(Continued)

OTHER PUBLICATIONS

"Office Action received for Korean Patent Application No. 10-2022-7023272, mailed on Sep. 3, 2024", 10 pages (5 pages of English Translation and 5 pages of Official Copy).
(Continued)

*Primary Examiner* — Michael H. Wilson
*Assistant Examiner* — Michael T Fulton
(74) *Attorney, Agent, or Firm* — MERCHANT & GOULD P.C.

(57) ABSTRACT

A system comprising an aerosol provision cartridge, a body to which the cartridge is attachable, and a tool. The cartridge comprises a refillable chamber for aerosolizable material, the chamber comprising an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool. At least one of the body and the cartridge may comprise a compartment for storing the tool, wherein the tool is removable from the compartment.

11 Claims, 8 Drawing Sheets

(51) Int. Cl.
*A24F 40/10* (2020.01)
*A24F 40/485* (2020.01)

(56) References Cited

U.S. PATENT DOCUMENTS

| | | | | |
|---|---|---|---|---|
| 9,943,107 | B2 | 4/2018 | Weigensberg | |
| 2008/0202630 | A1 | 8/2008 | Kax | |
| 2008/0309458 | A1 | 12/2008 | Fisher | |
| 2015/0257441 | A1* | 9/2015 | Gerkin | A24F 40/85 206/229 |
| 2015/0257447 | A1* | 9/2015 | Sullivan | A61M 15/06 131/329 |
| 2016/0184516 | A1 | 6/2016 | Shih et al. | |
| 2016/0255877 | A1 | 9/2016 | Wu | |
| 2016/0263324 | A1 | 9/2016 | Shaanan | |
| 2019/0053542 | A1 | 2/2019 | Chen | |
| 2019/0069601 | A1 | 3/2019 | Qiu | |
| 2019/0166913 | A1 | 6/2019 | Trzecieski | |
| 2019/0174826 | A1 | 6/2019 | Zhu | |
| 2019/0223506 | A1* | 7/2019 | Biel | A24F 15/015 |

FOREIGN PATENT DOCUMENTS

| | | | |
|---|---|---|---|
| EP | 2498113 | | 9/2012 |
| EP | 2531053 | A1 | 12/2012 |
| EP | 3138426 | A2 | 3/2017 |
| EP | 3498113 | A1 | 6/2019 |
| GB | 2533874 | A | 7/2016 |
| JP | S581658 | U | 1/1983 |
| JP | S59228138 | A | 12/1984 |
| JP | H0823364 | B2 | 3/1996 |
| JP | 2007068572 | A | 3/2007 |
| JP | 2009525078 | A | 7/2009 |
| JP | 2010531186 | A | 9/2010 |
| JP | 2013518577 | A | 5/2013 |
| JP | 2016512755 | A | 5/2016 |
| JP | 2017511703 | A | 4/2017 |
| JP | 2018534909 | A | 11/2018 |
| JP | 2020513246 | | 5/2020 |
| KR | 1020140070543 | A | 6/2014 |
| KR | 1020140088526 | A | 7/2014 |
| KR | 20180120819 | A | 11/2018 |
| RU | 2465791 | C1 | 11/2012 |
| RU | 2608915 | C2 | 1/2017 |
| RU | 2674503 | C1 | 12/2018 |
| RU | 2682539 | C1 | 3/2019 |
| RU | 2702242 | C2 | 10/2019 |
| RU | 2703127 | C2 | 10/2019 |
| WO | WO 2009/001078 | A2 | 12/2008 |
| WO | 2011125058 | A1 | 10/2011 |
| WO | WO 2016/127389 | A1 | 8/2016 |
| WO | 2018046530 | | 3/2018 |
| WO | 2018050030 | A1 | 3/2018 |

OTHER PUBLICATIONS

"Reasons for Refusal received for Japanese Application No. 2023-090730, mailed on Jul. 30, 2024", 10 pages (5 pages of English Translation and 5 pages of Official Copy).
"Extended European Search Report received for European Patent Application No. 23204443.8, mailed on Feb. 22, 2024", 7 pages.
"International Preliminary Report on Patentability received for PCT Patent Application No. PCT/GB2020/051868, mailed on Jul. 21, 2022", 8 Pages.
"Office Action received for Russian Patent Application No. 2022118595, mailed on Dec. 7, 2023", 14 pages (7 pages of English Translation and 7 pages of Official Copy).
"Office Action received for Ukrainian Patent Application No. 202202372, mailed on Jan. 22, 2024", 2 pages (Official Copy Only).
"Reasons for Refusal received for Japanese Patent Application No. 2022-541878, mailed on Oct. 24, 2023", 12 pages (6 pages of English Translation and 6 pages of Official Copy).
"Search Report received for Japanese Patent Application No. 2022-541878, mailed on Oct. 23, 2023", 15 pages (8 pages of English Translation and 7 pages of Official Copy).
International Search Report and Written Opinion, International Application No. PCT/GB2020/051868, mailing date Nov. 10, 2020, 15 pages.
Great Britain Search Report, Great Britain Application No. GB2000237.4, mailing date Jun. 29, 2020, 4 pages.
Notice of Allowance from Korean Application No. 10-2023-7032423 received Feb. 24, 2025, 5 pages.
Japanese Patent Application No. 2024112215, Office Action, mailed May 20, 2025, 8 pages.

* cited by examiner

AEROSOL PROVISION SYSTEM

PRIORITY CLAIM

The present application is a National Phase entry of PCT Application No. PCT/GB2020/051868, filed Aug. 5, 2020, which claims priority from Great Britain Application No. 2000237.4, filed Jan. 8, 2020, each of which is hereby fully incorporated herein by reference.

TECHNICAL FIELD

The present disclosure relates to aerosol provision cartridges, and systems and methods relating thereto.

BACKGROUND

Aerosol provision systems such as e-cigarettes generally contain, amongst other parts, an aerosol provision cartridge which comprises a reservoir of an aerosol precursor material, such as a source liquid or aerosolizable material, typically including nicotine, from which an aerosol is generated, e.g., through vaporization or other means. The aerosol provision cartridge may also comprise an aerosol generating component, such as a heater, which is fluidly connected to the aerosol precursor material contained in the reservoir. When a user inhales on the device, the aerosol generating component is activated to vaporize an amount of the aerosol precursor material. More particularly, such devices are usually provided with one or more air inlet holes located away from a mouthpiece of the system. When a user sucks on the mouthpiece, air is drawn in through the inlet holes and past the aerosol generating component. There is a flow path connecting between the aerosol generating component and an opening in the mouthpiece so that air drawn past the aerosol generating component continues along the flow path to the mouthpiece opening, carrying some of the aerosol produced from the aerosol generating component with it. The aerosol-carrying air exits the aerosol provision system through the mouthpiece opening for inhalation by the user.

Typical aerosol generating components comprise a heater. The aerosol precursor material is generally arranged within the system such that it can access the aerosol generating component. For example, it may be that the aerosol generating component is a wire which is heated during use of the device. As a result of the contact between the aerosol precursor material and the wire, when the wire is heated during use the aerosol precursor material is vaporized and subsequently condenses into an aerosol which is then inhaled by the user.

The means by which the aerosol precursor material can contact the wire may vary. It is not uncommon for the aerosol precursor material to be held freely in a refillable tank or other refillable storage region, and then directly fed to the heating wire (which may itself include a wick to assist in holding the aerosol precursor material in proximity to the wire).

To inhibit leakage of aerosol precursor material from such a refillable tank or storage region, and also to inhibit inadvertent access to such aerosol precursor material-holding regions by the user, it would be desirable to provide an aerosol provision system/cartridge which is configured accordingly.

SUMMARY

In a first aspect there is provided a system comprising an aerosol provision cartridge, a body to which the cartridge is attachable, and a tool; wherein the cartridge comprises a refillable chamber for aerosolizable material, the chamber comprising an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool; wherein at least one of the body and the cartridge comprises a compartment for storing the tool, wherein the tool is removable from the compartment.

In a second aspect there is provided an aerosol provision system comprising a refillable chamber for aerosolizable material, the chamber comprising an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of a tool; wherein the aerosol provision system comprises a compartment for storing the tool, wherein the tool is removable from the compartment.

In a third aspect there is provided an aerosol provision cartridge for use in an aerosol provision system comprising the cartridge and a body, wherein the cartridge comprises a refillable chamber for aerosolizable material, the chamber comprising an opening for the insertion of aerosolizable material into the chamber, wherein the aerosol provision cartridge further comprises a closure means for preventing access to the opening, wherein the closure means is moveable from a first position in which access to the opening is prevented, and a second position in which access to the opening is possible, wherein the aerosol provision cartridge is configured such that movement of the closure means between the first position and the second position requires use of a tool; wherein the aerosol provision cartridge comprises a compartment for storing the tool, wherein the tool is removable from the compartment.

In a fourth aspect there is provided a method of refiling a chamber for aerosolizable material in an aerosol provision system, wherein the aerosol provision system comprises a refillable chamber for aerosolizable material, wherein the chamber comprises an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of a tool stored in a compartment of the aerosol provision system; wherein the method comprises the steps of: removing the tool from the compartment of the aerosol provision system; utilizing the tool to move the closure means from the first position to the second position; filling the chamber with aerosolizable material; and utilizing the tool to move the closure means back from the second position to the first position.

In a fifth aspect there is provided a tool for use in moving the closure means from the system according to any of the first through third aspects.

The approach described herein is not restricted to specific embodiments such as those set out below, but includes and contemplates any appropriate combinations of features presented herein. For example, an electronic aerosol provision system may be provided in accordance with the approach described herein which includes any one or more of the various features described below as appropriate.

BRIEF DESCRIPTION OF THE DRAWINGS

Various embodiments will now be described in detail by way of example only with reference to the following drawings:

FIG. 8A in particular shows the tool initially engaging with a portion of the closure means.

FIGS. 8B and 8C in particular shows the tool being used to move the closure means between the first and second positions.

FIG. 8D in particular shows the tool failing as it is removed from the closure means.

DETAILED DESCRIPTION OF THE DRAWINGS

Figure 1:
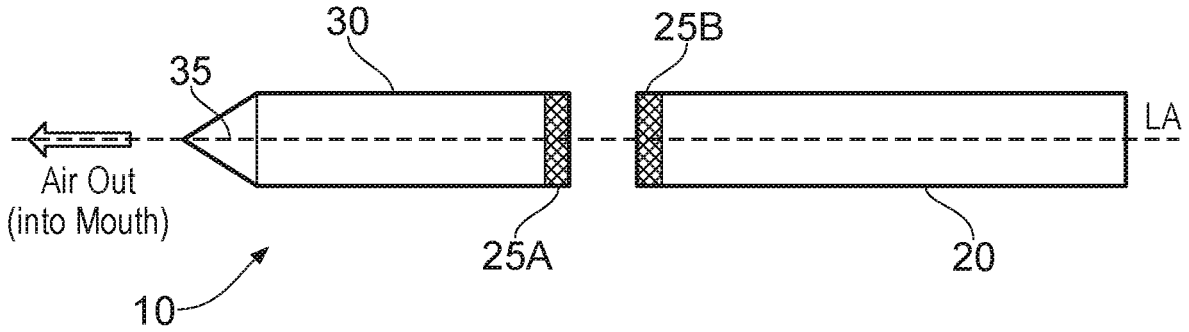
FIG. 1 is a schematic (exploded) diagram of an aerosol provision system such as an e-cigarette in accordance with some embodiments.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to non-combustible aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Aerosolizable material, which also may be referred to herein as aerosol generating material or aerosol precursor material, is material that is capable of generating aerosol, for example when heated, irradiated or energized in any other way.

Throughout the following description the term "e-cigarette" or "electronic cigarette" may sometimes be used, but it will be appreciated this term may be used interchangeably with aerosol provision system/device and electronic aerosol provision system/device. An electronic cigarette may also be known as a vaping device or electronic nicotine delivery system (END), although it is noted that the presence of nicotine in the aerosolizable material is not a requirement.

In some embodiments, the non-combustible aerosol provision system is a hybrid system to generate aerosol using a combination of aerosolizable materials, one or a plurality of which may be heated. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the article for use with the non-combustible aerosol provision device may comprise an aerosolizable material (or aerosol precursor material), an aerosol generating component (or vaporizer), an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol. In some embodiments, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurization or electrostatic means.

In some embodiments, the substance to be delivered may be an aerosolizable material which may comprise an active constituent, a carrier constituent and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, theine, a vitamin such as B6 or B12 or C, melatonin, a cannabinoid, or a constituent, derivative, or combinations thereof. The active constituent may comprise a constituent, derivative or extract of tobacco or of another botanical. In some embodiments, the active constituent is a physiologically active constituent and may be selected from nicotine, nicotine salts (e.g., nicotine ditartrate/nicotine bitartrate), nicotine-free tobacco substitutes, other alkaloids such as caffeine, or mixtures thereof.

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances, such constituents may be referred to as flavors, flavorants, cooling agents, heating agents, and/or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, coloring agents, preservatives, binders, fillers, stabilizers, and/or antioxidants.

As noted above, aerosol provision systems (e-cigarettes) often comprise a modular assembly including both a reusable part/body part (control unit) and a replaceable (disposable) cartridge part. Devices conforming to this type of two-part modular configuration may generally be referred to as two-part devices. It is also common for electronic cigarettes to have a generally elongate shape. For the sake of providing a concrete example, certain embodiments of the disclosure described herein comprise this kind of generally elongate two-part device employing disposable cartridges. However, it will be appreciated the underlying principles described herein may equally be adopted for other electronic cigarette configurations, for example modular devices comprising more than two parts, as devices conforming to other overall shapes, for example based on so-called box-mod high performance devices that typically have a more boxy shape.

FIG. 1 is a schematic diagram of an aerosol/vapor provision system such as an e-cigarette 10 in accordance with some embodiments (not to scale). The e-cigarette has a generally cylindrical shape, extending along a longitudinal axis indicated by dashed line LA, and comprises two main components, namely a body 20 and a cartridge 30. The cartridge includes an internal chamber containing an aerosolizable material storage region comprising aerosolizable material from which an aerosol is to be generated, and an aerosol generating component. The cartridge 30 further includes a mouthpiece 35 having an opening through which a user may inhale the aerosol produced by the aerosol generating component. In this regard, reference to an "aerosol generating component" refers to a component which generates an aerosol either directly or indirectly. For example, where the aerosol generating component is a heater, aerosolizable material may be evaporated and subsequently condense to form an aerosol.

The aerosolizable material storage region for the aerosolizable material may comprise a foam matrix or any other structure, such as a wadding, within a housing for retaining the aerosolizable material until such time that it is required to be delivered to the aerosol generating component. Alternatively, the aerosolizable material storage region may simply be a reservoir which an amount of "free aerosolizable material" contained therein. The aerosolizable material storage region is preferably re-fillable by the user.

The aerosol generating component includes a heater for vaporizing the aerosolizable material to form the aerosol. The aerosol generating component may further include a wick or similar facility to transport a small amount of the aerosolizable material from the storage region to a heating location on or adjacent the heater.

The body 20 includes a re-chargeable cell or battery to provide power for the e-cigarette 10 and a circuit board for generally controlling the e-cigarette. In use, when the heater receives power from the battery, as controlled by the circuit board, the heater vaporizes the aerosolizable material at the heating location to generate the aerosol, and this is then inhaled by a user through the opening in the mouthpiece. The aerosol is carried to the mouthpiece along an air channel that connects the aerosol generating region to the mouthpiece opening as a user inhales on the mouthpiece.

In this particular example, the body 20 and cartridge 30 are detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartridge 30. The electrical connector on the body 20 that is used to connect to the cartridge also serves as a socket for connecting a charging device (not shown) when the body is detached from the cartridge 30. The other end of the charging device can be plugged into an external power supply, for example a USB socket, to charge or to re-charge the cell/battery in the body of the e-cigarette. In other implementations, a cable may be provided for direct connection between the electrical connector on the body and the external power supply.

In connection with this, in order to allow for connection with the body 20 (both mechanically and electrically) the cartridge 30 generally contains one or more metallic components. For example, these components may be screw thread rings, electrodes, or intermediate supporting members (all not shown). When assembled, such metallic components allow for the cartridge 30 to be connected to the body 20 in a manner which supports the aerosol generating component in the aerosol generating region, allows for the provision of electrical current to the aerosol generating component, and allows for airflow to travel into the aerosol generating region so that it may collect the vapor/aerosol produced therein and deliver it to the user.

The e-cigarette 10 is provided with one or more holes (not shown in FIG. 1) for air inlet. These holes connect to an air running passage through above mentioned metallic components of the e-cigarette 10 to the mouthpiece 35. The air passage includes a region around the aerosol generating region and a section comprising an air channel connecting from the aerosol generating region to the opening in the mouthpiece.

When a user inhales through the mouthpiece 35, air is drawn into this air passage through the one or more air inlet holes, which are suitably located on the outside of the e-cigarette. This airflow (or the resulting change in pressure) is detected by a pressure sensor (as an example of an input means) that in turn activates the aerosol generating component (heater in this case) to vaporize a portion of the aerosolizable material to generate the aerosol. The airflow passes through the air passage, and combines with the aerosol in the region around the aerosol generating region, and the resulting aerosol then travels along the air channel connecting from the aerosol generating region to the mouthpiece 35 to be inhaled by a user. The cartridge 30 may be detached from the body 20 and disposed of when the supply of aerosolizable material is exhausted (and replaced with another cartridge if so desired), though preferably the cartridge is refillable.

It will be appreciated the e-cigarette 10 shown in FIG. 1 is presented by way of example, and various other implementations can be adopted. For example, in some embodiments, the cartridge 30 is provided as two separable components, namely a cartridge comprising the aerosolizable material storage region and mouthpiece (which can be replaced/refilled when the aerosolizable material from the reservoir is exhausted), and a vaporizer/aerosol generating component comprising a heater (which is generally retained). In some embodiments, the aerosol generating component may itself be replaceable.

Figure 2:
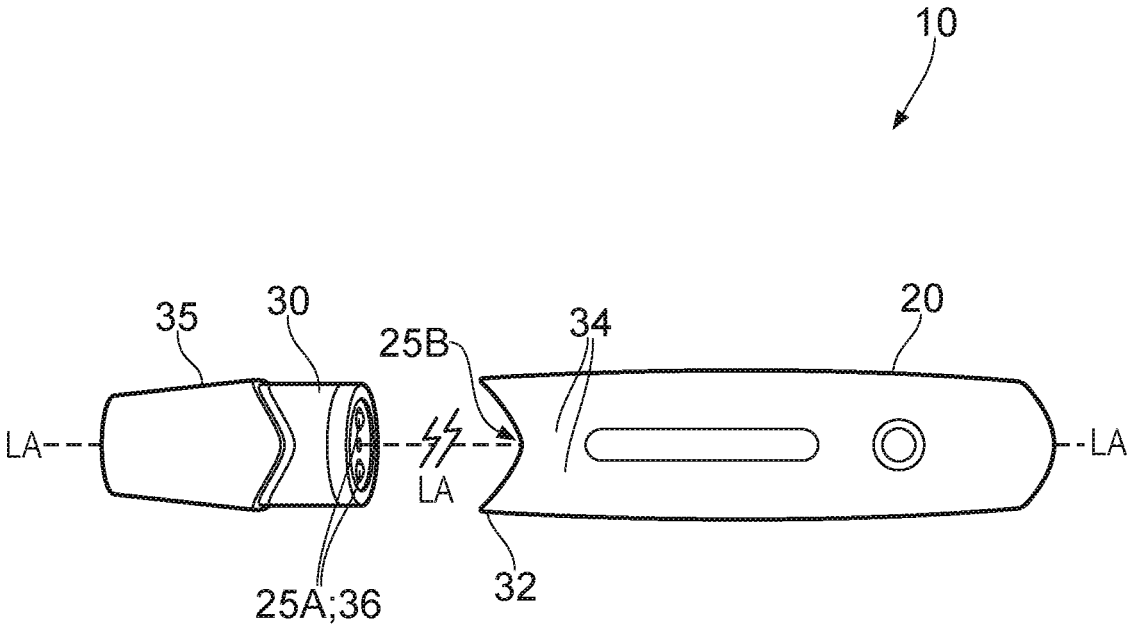
FIG. 2 is an illustration showing an embodiment of aerosol provision system.

With reference to FIG. 2, there is shown an embodiment of vapor provision system 10 comprising a body 20 attachable to a cartridge 30. The body 20 forms a generally cylindrical component extending along a longitudinal axis indicated by dashed line LA, and which comprises a recessed end 32 in which is contained electrical contacts 34. Together the recessed end 32 and the electrical contacts 34 form the connection 25B schematically shown in FIG. 1.

The cartridge 30 is attachable to the body 20 by inserting it into the recessed end 32 of the body 20. In this position, electrical contacts 36 located on the cartridge 30 make contact with the electrical contacts 34 from the body to allow power from a battery located inside the body 20 to be passed through to the cartridge 30.

Figure 3B:
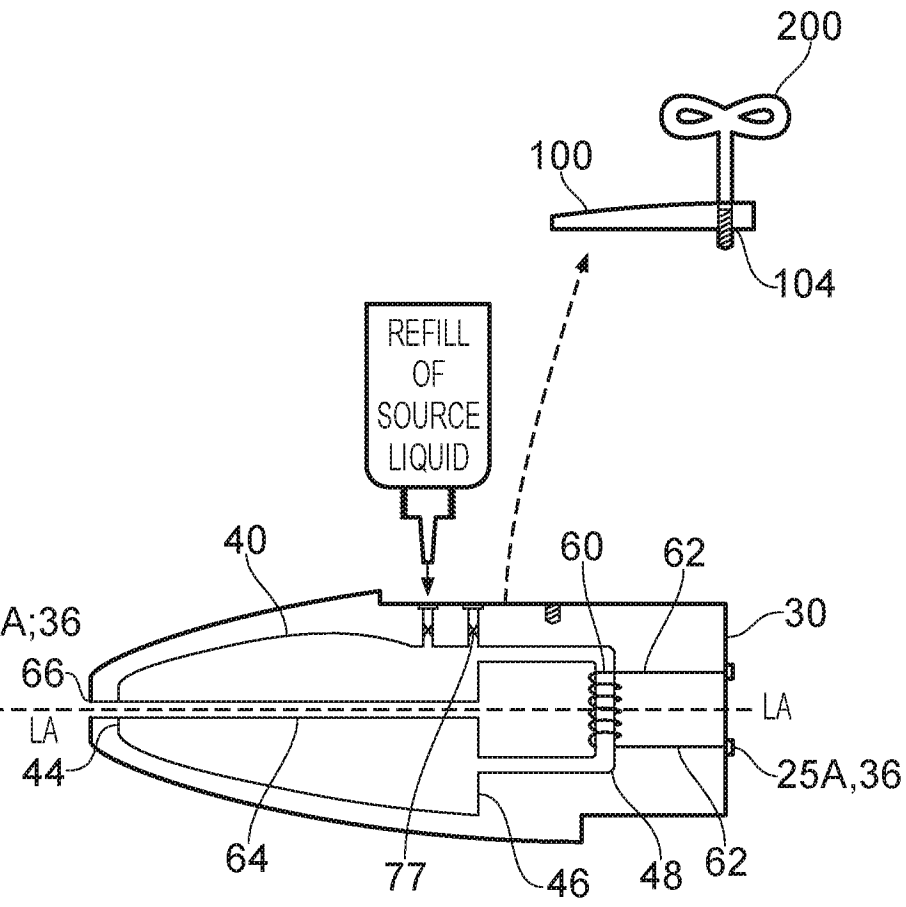
FIG. 3B shows a cross-sectional view of an embodiment of aerosol provision cartridge with a closure means in a second position.
Figure 3A:
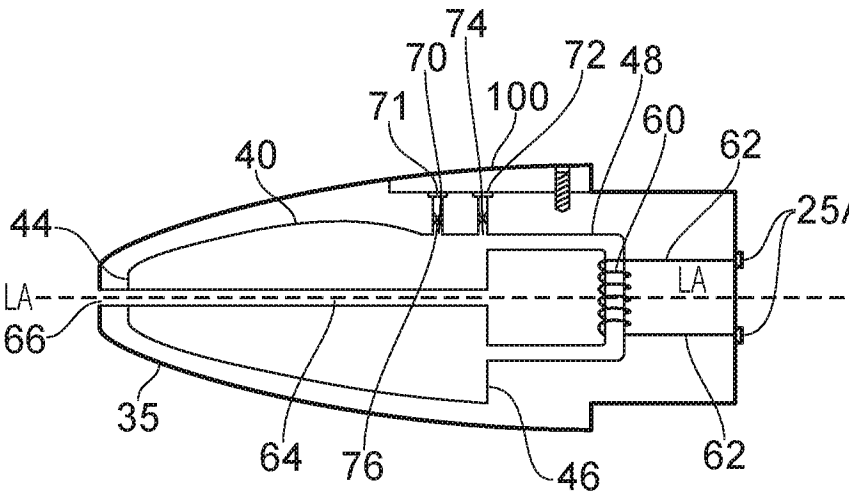
FIG. 3A shows a cross-sectional view of an embodiment of aerosol provision cartridge with a closure means in a first position.

With reference to FIGS. 3A and 3B, an embodiment of cartridge 30 is shown. In this embodiment, the cartridge 30 extends along the longitudinal axis indicated by dashed line LA, and comprises a chamber 40 for aerosolizable material. The chamber 40 defines a substantially frustoconical shape which comprises a first end 44 and a second end 46. During use of the cartridge 30, the first end 44 is that proximal the user's mouth when an inhalation is performed. The second end 46 of the chamber 40 comprises a U shaped channel 48 leading to an aerosol generating component 60 which is integral to the cartridge 30. By 'integral', this is meant that the aerosol generating component 60 cannot be removed from the cartridge 30 without dismantling or otherwise breaking the cartridge 30 in a manner which is not envisaged by the manufacturer. The two ends of the U shaped channel 48 each extend from the chamber 40 and the aerosol generating component 60 is located at the middle of the channel 48.

The aerosol generating component 60 is powered via an electrical connection 62 which extends between the aerosol generating component 60 and the electrical contacts 36 located on the cartridge 30 at the connection 25A. Aerosolizable material which is vaporized from the aerosol generating component 60 is delivered along an air outlet channel 64 which extends from the aerosol generating component 60 to an opening 66 from the cartridge 30 which is proximal the first end 44 of the chamber 40.

A mechanism is provided which allows the chamber 40 of the cartridge 30 to be refilled with aerosolizable material. In the embodiment shown in FIGS. 3A and 3B, a first refill opening 70 is provided for allowing aerosolizable material to be passed at pressure from outside the cartridge 30, through a first refill channel 71 into the chamber 40. In accordance with some embodiments of the cartridge 30, also extending from the exterior of the cartridge 30 may be a second air vent channel 72 which extends to a second opening 74 in the chamber 40 for allowing air to be vented from the chamber 40 during an aerosolizable material refilling process using the first channel 71.

For each cartridge 30, a closure means 100 is provided for preventing access to the first opening 70. In that respect, the closure means 100 is moveable from a first position in which access to the first opening 70 is prevented, and a second position in which access to the opening is possible. In that respect, the cartridge 30 is configured such that movement of the closure means 100 between the first position and the second position requires use of a tool 200.

In accordance with some embodiments of the cartridge, such as that shown in FIGS. 3A and 3B, the closure means 100 may comprise a cover portion 102 which covers the first and second openings 70; 74 in the first position (as shown in FIG. 3A), but which in the second position exposes these openings 70; 74 (as shown in FIG. 3B). In accordance with some embodiments, the closure means 100 may comprise, for instance, a fastening mechanism 104 (such as a screw) which affixes the cover portion 102 to the rest of the cartridge 30 when the closure means 100 is in the first position. In such embodiments, the tool 200 is then configured to engage with the fastening mechanism 104 to allow the cover portion 102 to be detached from the rest of the cartridge 30, such to expose the first opening 70 and provide access thereto.

It is envisaged that the closure means 100 and the corresponding tool 200 may take any required shape such to provide the required functionality of the closure means 100. In some particular embodiments, it is envisaged that at least one of closure means 100 and the tool 200 may comprise a projection for engaging with a corresponding recess in the other of the closure means 100 and the tool 200. This might be the case, for instance where the tool 200 comprises a hex key/allen wrench, and the closure means 100 comprises a fastening mechanism 104 with a corresponding head for engaging with the hex key/allen wrench.

Figure 4:
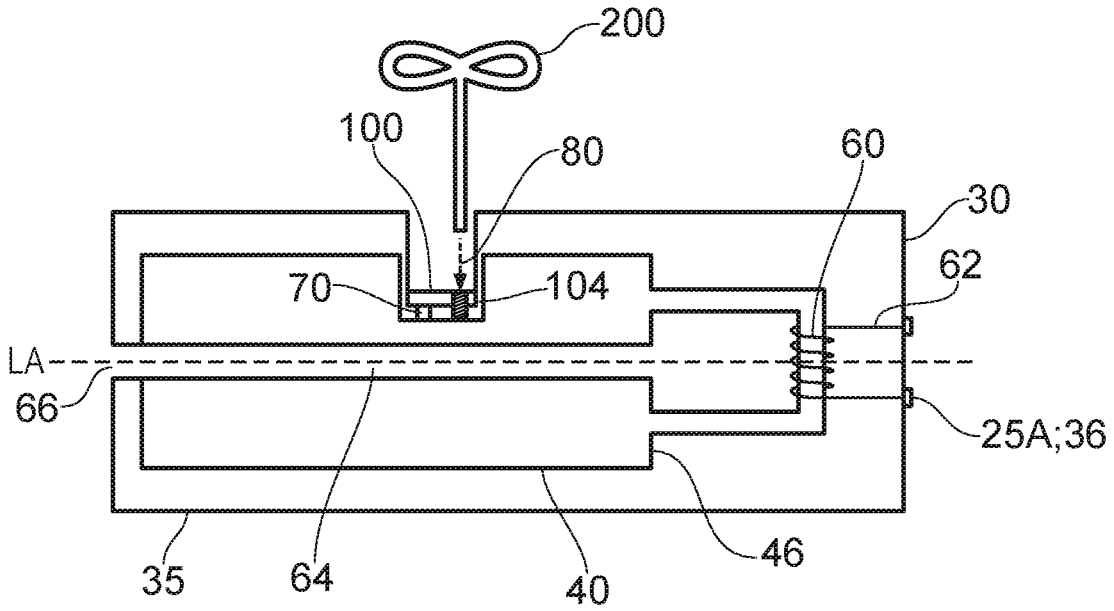
FIG. 4 shows a cross-sectional view of an embodiment of aerosol provision cartridge comprising a closure means located in a recess from the cartridge.

In accordance with some embodiments, the closure means 100 may be located in a recess 80 from the cartridge 30, such that the tool 200 is configured to be inserted inside the recess 80 for moving the closure means 100 between the first and second positions. An example of such an embodiment is shown in FIG. 4.

Figure 5:
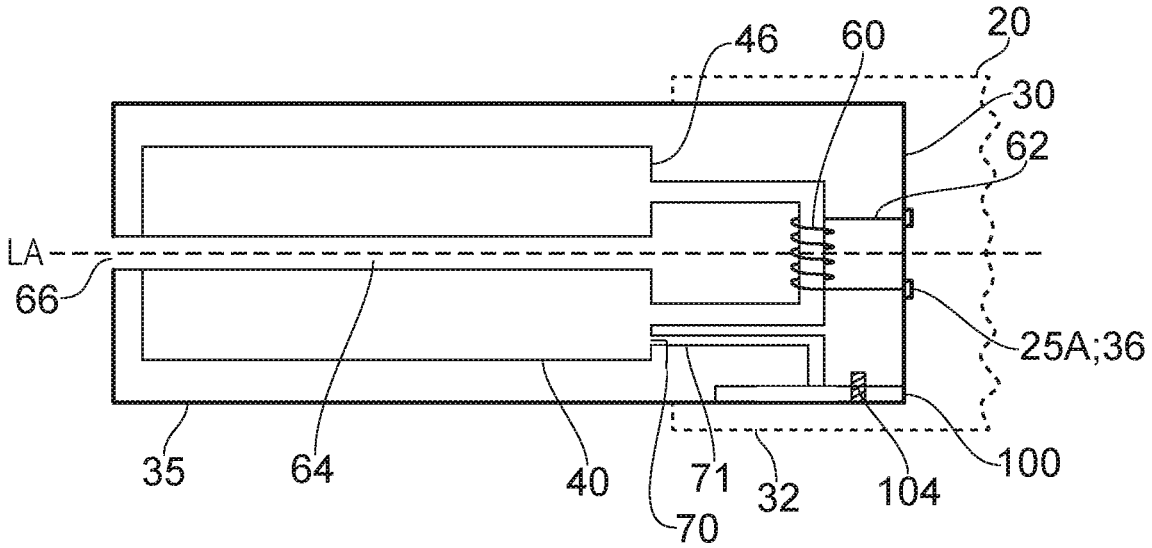
FIG. 5 shows a cross-sectional view of an embodiment of aerosol provision cartridge which is insertable in a recessed end of a body for accommodating the cartridge.

In accordance with some embodiments, the closure means 100 may be prevented by the body 20 from moving to the second position whilst the cartridge 30 is attached to the body 20. In this way therefore, the effectiveness of the closure means 100 at preventing inadvertent access to the chamber 40 of the cartridge 30 is increased. An example of such an embodiment is shown in FIG. 5, where the cartridge 30 is attachable to the body 20 by inserting it into the recessed end 32 of the body 20. In this embodiment, the closure means 100 is covered inside the recessed end 32 of the body 20 when the cartridge 30 is attached to the body 20.

In terms of the exact positioning for the closure means 100 and the first opening 70 (and any associated second opening 74), it will be appreciated that their exact position may be varied depending on the intended geometry for the cartridge 30. In that respect therefore, in some embodiments, each opening 70; 74 may be located at the first end 44 of the chamber 40 in a position proximal the opening 66 through which the user inhales vapor generated by the aerosol generating component 60. In other embodiments, each opening 70; 74 may be positioned on the cartridge 30 in a position that is at, or that is more proximal to, the second end 46 of the chamber 40.

Figure 6:
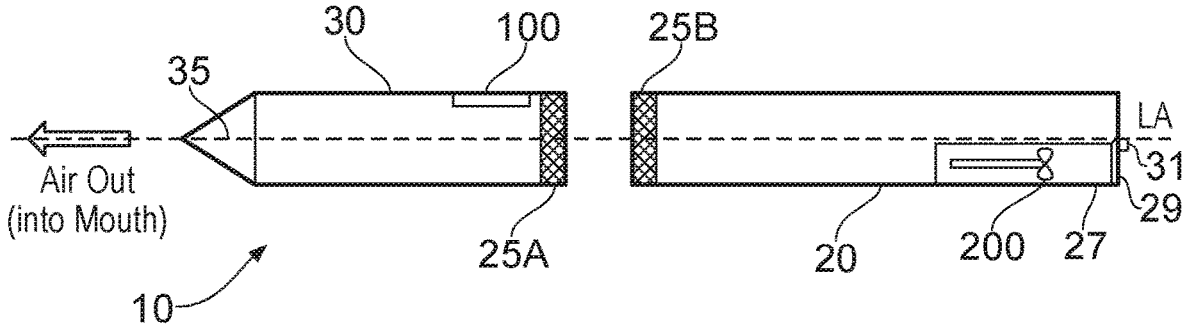
FIG. 6 shows a schematic cross-sectional view of an embodiment of aerosol provision system comprising a compartment for storing a tool for use with a closure means present on the cartridge.

In accordance with some embodiments, it is envisaged that the body 20 may comprise a compartment 27 for storing the tool 200, wherein the tool 200 is removable from the compartment 27. In some particular embodiments, the body 20 may also comprise a cover 29 for covering the compartment 27 when the compartment 27 is storing the tool 200 when it is not in use. An example of such an embodiment is shown in the simplified schematic of FIG. 6.

In particular embodiments where the compartment 27 is present, a lock 31 may be provided on the body 20 for preventing access to the compartment 27 (and its associated tool 200). In some particular embodiments, the lock 31 may comprise a physical lock (such as a padlock or a combination lock) and/or an electronic lock.

With reference to the above embodiments where the compartment 27 is present, it will be appreciated that in some embodiments, the compartment 27 may be provided on the cartridge 30 as opposed to the body 20.

Figure 7B:
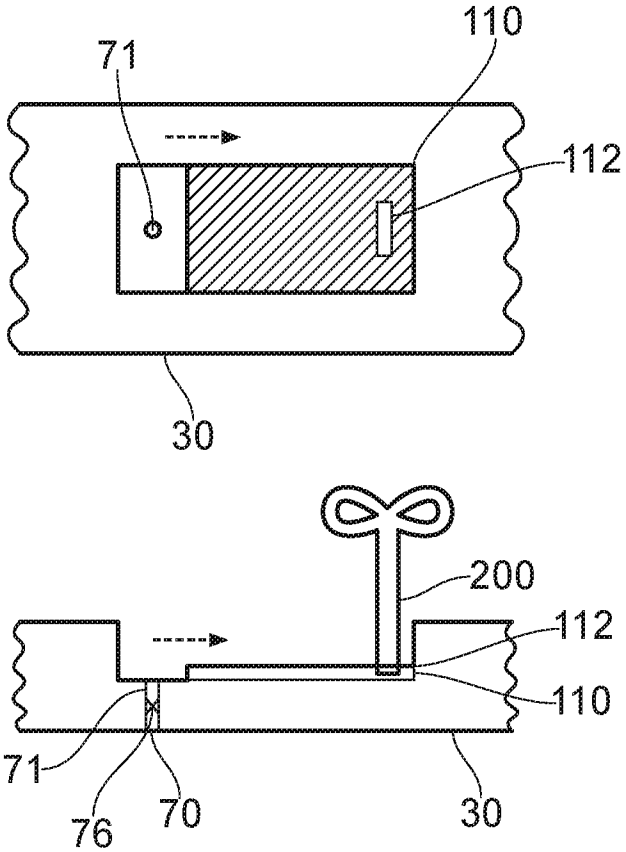
FIG. 7B shows respective plan and cross-sectional views of an embodiment of aerosol provision system comprising a sliding member moveable between an open and closed positions, with the sliding member in the open position.
Figure 7A:
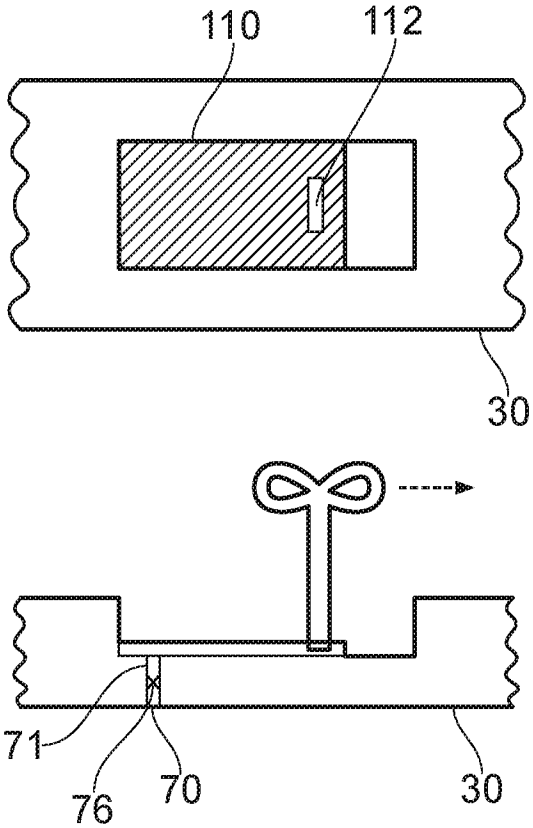
FIG. 7A shows respective plan and cross-sectional views of an embodiment of aerosol provision system comprising a sliding member moveable between an open and closed positions, with the sliding member in the closed position.

It will be appreciated that in some embodiments, the closure means 100 need not expressly comprise a fastening mechanism 104. In that respect, in accordance with some embodiments, such as that shown in FIGS. 7A and 7B, the closure means 100 may comprise a sliding member 110. The sliding member in these embodiments may be slideable between a closed position (shown in FIG. 7A) in which access to the first opening 70 is prevented, and an open position (shown in FIG. 7B) in which access to the opening is possible. In such embodiments, the sliding member 110 may be configured to require the use of the tool 200 to slide the sliding member 110 between its open and closed positions. In that respect, this may be achieved by having the sliding member 110 sufficiently narrow or shaped such that a user cannot move the sliding member 110 using their hands alone (i.e. without the use of the tool), or might provide a sufficiently resistive or frictional force between the sliding member 110 and the surface on which the sliding member 110 is configured to slide such that the use of the tool 200 is required to provide a sufficient force which can overcome this resistive/frictional force such to move the sliding member 110. In some particular embodiments, the siding member 110 may be provided with a surface feature 112—such as a surface projection or surface protrusion, which is configured to be gripped by the tool 200 for moving the sliding member 110 between its open and closed positions. In the particular embodiments shown in FIGS. 7A and 7B, no fastening mechanism 104 is present on the closure means 100, though it will be appreciated that in some other embodiments, a fastening mechanism 104 could be further provided whose opening requires use of the tool 200.

In accordance with some embodiments, the cartridge 30 may additionally comprise a source aerosolizable material valve 76, which may be a one way valve, located in the first channel 71 for allowing aerosolizable material to be passed at pressure from outside the cartridge 30. In this way, escape of aerosolizable material from the first channel 71 can be inhibited even when the closure means 100 is in the second position.

In a similar vein with respect to the second air vent channel 72, and its second opening 74, where these are present, in accordance with some of these embodiments, an air vent valve 77 may be located in the second channel 72 to allow for excess air from the chamber 40 to be vented from the chamber 40 during a refilling process of aerosolizable material into the chamber 40 via the first channel 71.

In accordance with some embodiments, it is envisaged that the tool 200 and/or the closure means 100 may be configured to be single-use. In that respect, in some embodiments, as a result of, or following the movement of, the closure means 100 from the second position to the first position, and/or following the removal of the tool 200 from the securing means 100, at least one of the closure means 100 and the tool 200 may be then rendered inoperable for further use. In this way, the chamber 40 can be refilled with aerosolizable material only once. An application for this configuration might be for instance, where a refill container of aerosolizable material is supplied with the tool 200. In such an application, the tool can be used to move the closure means 100 to the second position, to allow the chamber 40 to be refilled with aerosolizable material. Once the chamber has been refilled, and the tool 200 then used to move the closure means 100 back to the first position, the tool 200 may then be configured to shear/fail as part of the removal process from the closure means 100 such that the tool 200 cannot be used again. An example of such an embodiment is shown in FIGS. 8A-8D. In that exemplary embodiment, the tool 20 comprises a pair of resilient leg portions 202, wherein a distal end of each leg portion 202 comprises an inwardly extending foot portion/projection 204. Each resilient leg portion 202 is configured to be resiliently deflected by, and engage over, a shoulder portion 114 from the closure means 100. In the particular embodiment shown in FIGS. 8A-8D, the shoulder portion 114 may be located on a fastening mechanism 104 from the closure means 100.

Figures 8A, 8B, 8C, 8D:
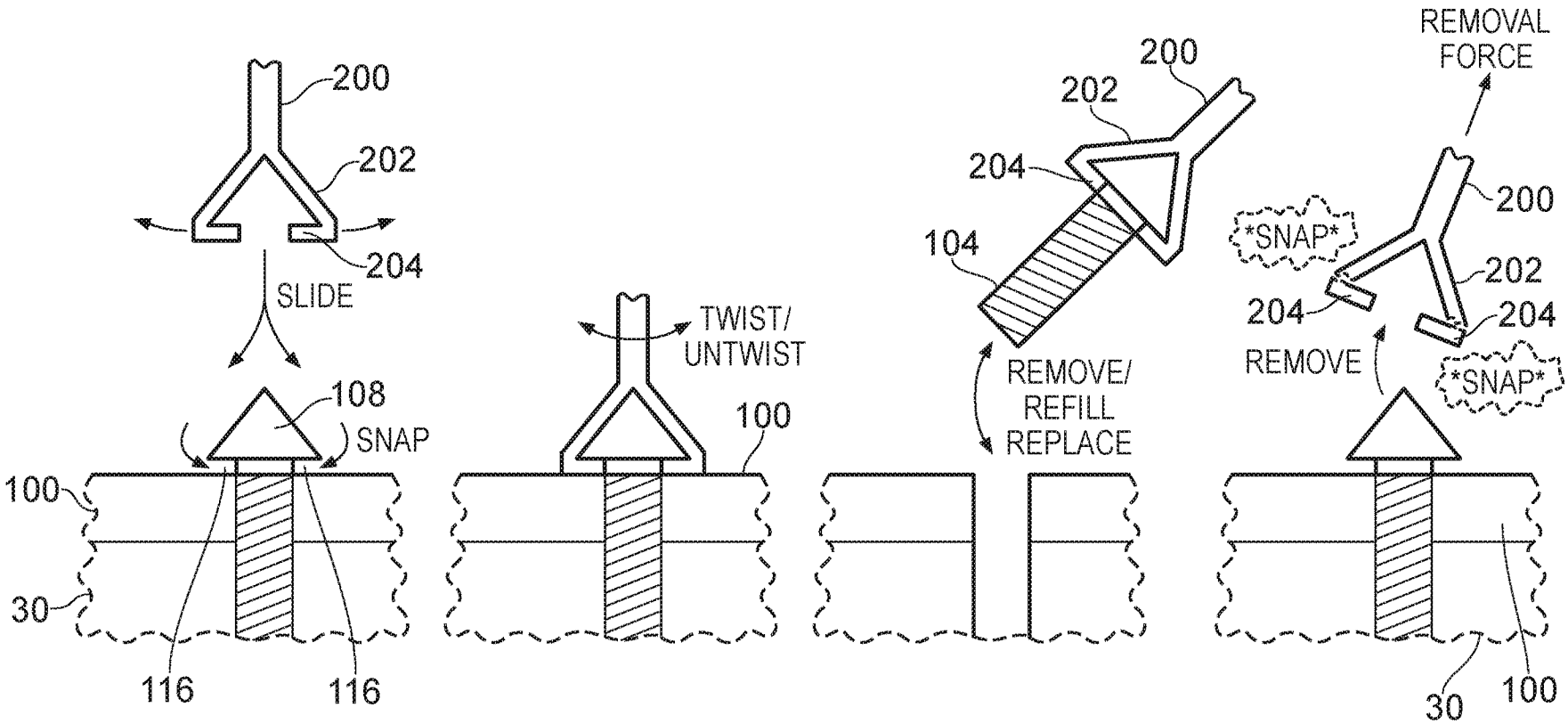
FIGS. 8A-8D show schematic cross-sectional views of an embodiment of aerosol provision system comprising closure means for use with a tool, wherein movement of the closure means from a second position to a first position is configured to render at least one of the closure means and the tool inoperable for further use.

Once each resilient leg portion 202 engages over the shoulder portion 114, the foot portion 204 from the tool 200 may be then accommodated inside a recessed portion 116 of the closure means 100, such that the tool 200 is engaged with the closure means 100, as shown for instance with reference to the example embodiment shown in FIG. 8B. From this engaged position, the tool 200 may then be used to move the closure means 100 between the first position and the second position, as shown for instance with reference to FIGS. 7B and 7C where the tool may be twisted to disengage the fastening means 104 such to allow the closure means 100 to be moved to its second position as shown in FIG. 8C.

From the second position of the closure means 100, the chamber 40 may be then refilled with aerosolizable material, and the tool 200 then used to move the closure means 100 back to its first position, for instance back to the position shown in FIG. 8B with reference to the embodiment shown in FIGS. 8A-8D. From this first position, in accordance with some embodiments such as that shown in FIG. 8D, upon removal of the tool 200 from the securing means 100, the tool 200 may be then configured to fail such that it is rendered inoperable for further use. In that respect, with reference to the particular embodiment shown in FIG. 8D, it can be seen that the failure is caused by each foot portion 204 shearing from the rest of the tool 200 (the shearing caused by the removal force of the user on the tool 200 against the force of the shoulder portion 114 acting on the foot portion 204 of the tool 200).

Thus, described above are examples of aerosol provision systems and cartridges that can mitigate against inadvertent user access to the aerosolizable material-holding region of such systems, by being provided with a closure means and an associated tool. In that respect, and for the avoidance of any doubt, it will be appreciated that the techniques herein described for mitigating against inadvertent user access to an aerosolizable material-holding region need not expressly be used in an aerosol provision system which comprises a cartridge 30 and a body 20 separable from the cartridge 30.

Mindful of the above, there has been at least described a system comprising an aerosol provision cartridge, a body to which the cartridge is attachable, and a tool; wherein the cartridge comprises a refillable chamber for aerosolizable material, the chamber comprising an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool; wherein at least one of the body and the cartridge comprises a compartment for storing the tool, wherein the tool is removable from the compartment.

There has also been described an aerosol provision system comprising a refillable chamber for aerosolizable material, the chamber comprising an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of a tool; wherein the aerosol provision system comprises a compartment for storing the tool, wherein the tool is removable from the compartment.

There has also been described an aerosol provision cartridge for use in an aerosol provision system comprising the cartridge and a body, wherein the cartridge comprises a refillable chamber for aerosolizable material, the chamber comprising an opening for the insertion of aerosolizable material into the chamber, wherein the aerosol provision cartridge further comprises a closure means for preventing access to the opening, wherein the closure means is moveable from a first position in which access to the opening is prevented, and a second position in which access to the opening is possible, wherein the aerosol provision cartridge is configured such that movement of the closure means between the first position and the second position requires use of a tool; wherein the aerosol provision cartridge comprises a compartment for storing the tool, wherein the tool is removable from the compartment.

There has also been described a method of refiling a chamber for aerosolizable material in an aerosol provision system, wherein the aerosol provision system comprises a refillable chamber for aerosolizable material, wherein the chamber comprises an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of a tool stored in a compartment of the aerosol provision system; wherein the method comprises the steps of: removing the tool from the compartment of the aerosol provision system; utilizing the tool to move the closure means from the first position to the second position; filling the chamber with aerosolizable material; and utilizing the tool to move the closure means back from the second position to the first position.

Also described herein is a system comprising an aerosol provision cartridge 30, a body 20 to which the cartridge 30 is attachable, and a tool 200. The cartridge 30 comprises a refillable chamber 40 for aerosolizable material, the chamber 40 comprising an opening 70 for the insertion of aerosolizable material into the chamber 40, wherein the cartridge 30 further comprises a closure means 100 for preventing access to the opening 70, wherein the closure means 100 is moveable from a first position in which access to the opening 70 is prevented, and a second position in which access to the opening is possible, wherein the cartridge 30 is configured such that movement of the closure means 100 between the first position and the second position requires use of the tool 200. At least one of the body 20 and the cartridge 30 may comprise a compartment 27 for storing the tool 200, wherein the tool 200 is removable from the compartment 27.

Also described herein are embodiments relating to the following numbered clauses and examples:

Clause 1. A system comprising an aerosol provision cartridge, and a tool; wherein the cartridge comprises a refillable chamber for aerosolizable material, the chamber comprising an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool.

Clause 2. A system according to clause 1, wherein the cartridge further comprises an aerosol generating component.

Clause 3. A system according to clause 2, wherein the aerosol generating component is located in the chamber.

Clause 4. A system according to any of clause 1 to 3, wherein the closure means is located in a recess from the cartridge, and the tool is configured to be inserted inside the recess for moving the closure means between the first and second positions.

Clause 5. A system according to any of clause 1 to 4, further comprising a body to which the cartridge is attachable.

Clause 6. A system according to clause 5, wherein the closure means is prevented by the body from moving to the second position whilst the cartridge is attached to the body.

Clause 7. A system according to clause 5 or 6, wherein the closure means is covered by the body whilst the cartridge is attached to the housing.

Clause 8. A system according to any of clause 5 to 7, wherein the body comprises a compartment for storing the tool, wherein the tool is removable from the compartment.

Clause 9. A system according to any of clause 1 to 7, wherein the cartridge comprises a compartment for storing the tool, wherein the tool is removable from the compartment.

Clause 10. A system according to clause 8 or 9, further comprising a cover for covering the compartment when the compartment is storing the tool when it is not in use.

Clause 11. A system according to clause 10, further comprising a lock for preventing access to the compartment.

Clause 12. A system according to clause 11, wherein the lock comprises a physical lock.

Clause 13. A system according to clause 11 or 12, wherein the lock comprises an electronic lock.

Clause 14. A system according to any of clause 1 to 13, wherein at least one of the tool and the securing means is configured to be single-use.

Clause 15. A system according to any of clause 1 to 14, wherein the tool is configured to be removed from the closure means after it has been utilized to move the closure means back from the second position to the first position; and wherein the tool is configured to fail as a result of its removal from the closure means.

Clause 16. A system according to any of clause 1 to 15, wherein the closure means comprises a valve for inhibiting aerosolizable material passing from the cartridge when the closure means is in the second position.

Clause 17. A system according to any of clause 1 to 16, wherein the closure means comprises a sliding member which is slideable between a closed position in which access to the first opening is prevented, and an open position in which access to the opening is possible, wherein the sliding member is configured to require the use of the tool to slide the sliding member between the open position and the closed position.

Clause 18. A method of refiling a chamber for aerosolizable material in an aerosol provision cartridge, wherein the cartridge comprises a refillable chamber for aerosolizable material, wherein the chamber comprises an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool; wherein the method comprises the steps of:

utilizing the tool to move the closure means from the first position to the second position;

filling the chamber with aerosolizable material; and utilizing the tool to move the closure means back from the second position to the first position.

Clause 19. A method according to clause 18, wherein the tool is configured to be removed from the closure means after it has been utilized to move the closure means back from the second position to the first position; and wherein the tool is configured to fail as a result of its removal from the closure means.

Clause 20. A tool for use in moving the closure means from the system of any of clause 1 to 17.

Example 1. A system comprising an aerosol provision cartridge, and a tool; wherein the cartridge comprises a refillable chamber for aerosolizable material, the chamber comprising an opening for the insertion of aerosolizable material into the chamber, wherein the cartridge further comprises a closure means for preventing access to the opening, wherein the closure means is moveable from a first position in which access to the opening is prevented, and a second position in which access to the opening is possible, wherein the cartridge is configured such that movement of the closure means between the first position and the second position requires use of the tool, wherein the tool is configured to be removed from the closure means after it has been utilized to move the closure means back from the second position to the first position; and wherein the tool is configured to fail as a result of its removal from the closure means.

Example 2. A system according to example 1, wherein the cartridge further comprises an aerosol generating component.

Example 3. A system according to example 2, wherein the aerosol generating component is located in the chamber.

Example 4. A system according to any of example 1 to 3, wherein the closure means is located in a recess from the cartridge, and the tool is configured to be inserted inside the recess for moving the closure means between the first and second positions.

Example 5. A system according to any of example 1 to 4, further comprising a body to which the cartridge is attachable.

Example 6. A system according to example 5, wherein the closure means is prevented by the body from moving to the second position whilst the cartridge is attached to the body.

Example 7. A system according to example 5 or 6, wherein the closure means is covered by the body whilst the cartridge is attached to the housing.

Example 8. A system according to any of example 5 to 7, wherein the body comprises a compartment for storing the tool, wherein the tool is removable from the compartment.

Example 9. A system according to any of example 1 to 7, wherein the cartridge comprises a compartment for storing the tool, wherein the tool is removable from the compartment.

Example 10. A system according to example 8 or 9, further comprising a cover for covering the compartment when the compartment is storing the tool when it is not in use.

Example 11. A system according to example 10, further comprising a lock for preventing access to the compartment.

Example 12. A system according to example 11, wherein the lock comprises a physical lock.

Example 13. A system according to example 11 or 12, wherein the lock comprises an electronic lock.

Example 14. A system according to any of example 1 to 13, wherein at least one of the tool and the securing means is configured to be single-use.

Example 15. A system according to any of example 1 to 14, wherein the closure means comprises a valve for inhibiting aerosolizable material passing from the cartridge when the closure means is in the second position.

Example 16. A system according to any of example 1 to 15, wherein the closure means comprises a sliding member which is slideable between a closed position in which access to the first opening is prevented, and an open position in which access to the opening is possible, wherein the sliding member is configured to require the use of the tool to slide the sliding member between the open position and the closed position.

Example 17. An aerosol provision system comprising a tool, and a refillable chamber for aerosolizable material, the chamber comprising an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of the tool;

wherein the tool is configured to be removed from the closure means after it has been utilized to move the closure means back from the second position to the first position; and wherein the tool is configured to fail as a result of its removal from the closure means.

Example 18. An aerosol provision system according to example 17, further comprising an aerosol provision cartridge and a body to which the cartridge is attachable, wherein the aerosol provision cartridge comprises the refillable chamber.

Example 19. A method of refiling a chamber for aerosolizable material in an aerosol provision system, wherein the aerosol provision system comprises a refillable chamber for aerosolizable material, wherein the chamber comprises an opening for the insertion of aerosolizable material into the chamber, wherein the aerosol provision system further comprises a closure means for preventing access to the opening, wherein the closure means is moveable from a first position in which access to the opening is prevented, and a second position in which access to the opening is possible, wherein the aerosol provision system is configured such that movement of the closure means between the first position and the second position requires use of a tool; wherein the method comprises the steps of:

utilizing the tool to move the closure means from the first position to the second position;

filling the chamber with aerosolizable material; and utilizing the tool to move the closure means back from the second position to the first position, wherein the tool is configured to be removed from the closure means after it has been utilized to move the closure means back from the second position to the first position; and wherein the tool is configured to fail as a result of its removal from the closure means.

Example 20. A method according to example 19, wherein the aerosol provision system further comprises an aerosol provision cartridge and a body to which the cartridge is attachable, wherein the aerosol provision cartridge comprises the refillable chamber.

Example 21. A tool for use in moving the closure means from the system of any of example 1 to 16.

Example 22. A tool comprising at least one resilient portion which is configured to be resiliently deflected by, and engage over, a closure means from an aerosol provision system, wherein upon removal of the tool from the closure means, the resilient portion of the tool is configured to shear from the rest of the tool to prevent the tool from being reused.

Example 23. A tool according to example 22, wherein the at least one resilient portion comprises a pair of resilient leg portions, wherein a distal end of each leg portion comprises a projection for engaging with the aerosol provision system.

Example 24. A tool according to example 23, wherein each projection comprises an inwardly extending projection.

Example 25. A tool according to example 23 or 24, wherein the tool comprises a proximal end for gripping by a user during use of the tool.

In order to address various issues and advance the art, this disclosure shows by way of illustration various embodiments in which the disclosure may be practiced. The advantages and features of the disclosure are of a representative sample of embodiments only, and are not exhaustive and/or exclusive. They are presented only to assist in understanding and to teach the disclosure. It is to be understood that advantages, embodiments, examples, functions, features, structures, and/or other aspects of the disclosure are not to be considered limitations on the disclosure, and that other embodiments may be utilized and modifications may be made without departing from the scope of the disclosure. Various embodiments may suitably comprise, consist of, or consist essentially of, various combinations of the disclosed elements, components, features, parts, steps, means, etc. other than those specifically described herein, and it will thus be appreciated that features may be combined with features in combinations other than those explicitly set out in the disclosure. The disclosure may include inventions not presently claimed, but which may be claimed in future.

In the above respect, it will be appreciated for instance that the exact positioning of the aerosol generating component 60 may be varied as required so long as it is able to vaporize aerosolizable material from the chamber 40 and deliver it along the air outlet channel 64 which extends from the aerosol generating component 60 to the opening 66 from the cartridge 30. In that respect therefore, it will be appreciated that in some embodiments, the aerosol generating component 60 may be located in the chamber 40.

The invention claimed is:

1. An aerosol provision system comprising a heater and a refillable chamber for aerosolizable material, the chamber comprising an opening for the insertion of aerosolizable material into the chamber;

wherein the aerosol provision system further comprises a closure means comprising a detachable cover portion and a fastening mechanism;

wherein the closure means is moveable from a first attached position and a second detached position in which the closure means is entirely detached from the rest of the aerosol provision system;

wherein the aerosol provision system is configured such that movement of the closure means between the first attached position and the second detached position requires use of a tool which is configured to engage with the closure means to allow the closure means to be moved to the second detached position;

wherein the aerosol provision system further comprises an air vent channel which extends to a second opening in the chamber for allowing air to be vented from the chamber when aerosolizable material is inserted into the chamber; and wherein the cover portion covers the air vent channel in the first attached position;

wherein the aerosol provision system further comprises a body comprising a first recessed end in which the heater is configured to be located, wherein the closure means is configured to be located next to the first recessed end in the first attached position of the closure means.

2. A tool for use in moving the closure means from the system of claim 1.

3. The aerosol provision system of claim 1, wherein when the tool is engaged with the closure means, the tool is configured to be twisted to move the closure means to the second, detached, position.

4. The aerosol provision system of claim 1, wherein the closure means comprises a recessed portion in which the tool is configured to be accommodated inside for allowing the tool to engage with the closure means to allow the closure means to be moved to the second, detached, position.

5. The aerosol provision system of claim 1, wherein access to the opening is possible when the closure means is in the detached position.

6. The aerosol provision system of claim 1, wherein at least one of the closure means and the tool comprises a projection for engaging with a corresponding recess in the other of the closure means and the tool.

7. The aerosol provision system of claim 1, wherein the chamber comprises a first end, wherein the opening is located at the first end.

8. The aerosol provision system of claim 1, wherein the fastening means comprises a screw thread.

9. The aerosol provision system of claim 1, further comprising a mouthpiece, wherein the closure means is configured to be located next to the mouthpiece when the closure means is located in the first attached position.

10. The aerosol provision system of claim 9, further comprising an outlet for delivering aerosolizable material, which is vaporized by the aerosol provision system, to a user of the aerosol provision system;

wherein the mouthpiece is located between the outlet and the closure means when the closure means is located in the first attached position.

11. The aerosol provision system of claim 1, wherein the closure means extends about a portion of a circumference of the first recessed end of the body when the closure means is located in the first attached position.

* * * * *